US011270643B2

(12) United States Patent
Lee et al.

(10) Patent No.: US 11,270,643 B2
(45) Date of Patent: Mar. 8, 2022

(54) NON-RECTANGULAR DISPLAY AND DRIVING METHOD THEREOF

(71) Applicant: SAMSUNG DISPLAY CO., LTD., Yongin-si (KR)

(72) Inventors: Seung-Kyu Lee, Asan-si (KR); Tae Hoon Kim, Cheonan-si (KR); Jae Du Noh, Mokpo-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

(21) Appl. No.: 16/744,075

(22) Filed: Jan. 15, 2020

(65) Prior Publication Data

US 2020/0152131 A1 May 14, 2020

Related U.S. Application Data

(62) Division of application No. 14/872,926, filed on Oct. 1, 2015, now Pat. No. 10,546,534.

(30) Foreign Application Priority Data

Jan. 27, 2015 (KR) ..... 10-2015-0013045

(51) Int. Cl.
*G09G 3/3258* (2016.01)
*G09G 3/3266* (2016.01)
(Continued)

(52) U.S. Cl.
CPC ..... *G09G 3/3258* (2013.01); *G09G 3/3233* (2013.01); *G09G 3/3266* (2013.01);
(Continued)

(58) Field of Classification Search
CPC .. G09G 3/3233; G09G 3/3258; G09G 3/3266; G09G 3/3291; G09G 2300/0426;
(Continued)

(56) References Cited

U.S. PATENT DOCUMENTS 5,898,645 A 4/1999 Sugiyama
8,890,181 B2 11/2014 Wang et al.
(Continued)

FOREIGN PATENT DOCUMENTS

EP 2743762 A1 6/2014
EP 2743765 A1 6/2014
(Continued)

OTHER PUBLICATIONS

EPO Extended Search Report dated Jun. 8, 2016, for corresponding European Patent Application No. 16152971.4 (9 pages).
(Continued)

*Primary Examiner* — Alexander Eisen
*Assistant Examiner* — Nathaniel P Brittingham
(74) *Attorney, Agent, or Firm* — Lewis Roca Rothgerber Christie LLP

(57) ABSTRACT

A non-rectangular display includes: a plurality of first signal lines extending along a first direction; a plurality of DC voltage lines extending along the first direction; and a plurality of second signal lines extending along the first direction, wherein a first DC voltage line of the plurality of DC voltage lines is between a first line of the plurality of first signal lines and a second line of the plurality of second signal lines, a second DC voltage line of the plurality of DC voltage lines is between a third line of the plurality of first signal lines and a fourth line of the plurality of second signal lines, and the first and third lines are adjacent to each other, or the second and fourth lines are adjacent to each other.

6 Claims, 9 Drawing Sheets

(51) Int. Cl.
*G09G 3/3291* (2016.01)
*G09G 3/3233* (2016.01)

(52) U.S. Cl.
CPC ... *G09G 3/3291* (2013.01); *G09G 2300/0426* (2013.01); *G09G 2300/0819* (2013.01); *G09G 2300/0842* (2013.01); *G09G 2300/0861* (2013.01); *G09G 2310/0281* (2013.01); *G09G 2320/0209* (2013.01); *G09G 2320/0219* (2013.01); *G09G 2320/045* (2013.01)

(58) Field of Classification Search
CPC ... G09G 2300/0819; G09G 2300/0842; G09G 2300/0861; G09G 2310/0281; G09G 2320/0209; G09G 2320/0219; G09G 2320/045; G09G 3/32–3291
See application file for complete search history.

(56) References Cited

U.S. PATENT DOCUMENTS

2005/0174313 A1 8/2005 Kawachi
2007/0023752 A1 2/2007 Nakamura
2007/0035485 A1 2/2007 Yoon
2008/0136801 A1 6/2008 Shie
2008/0150846 A1 6/2008 Chung
2008/0186271 A1* 8/2008 Yokoyama ..... G02F 1/136213 345/100
2008/0225216 A1 9/2008 Shimodaira
2009/0102758 A1* 4/2009 Anzai ..... G09G 3/2096 345/76
2009/0273547 A1 11/2009 Tanikame et al.
2010/0060842 A1 3/2010 Igeta et al.
2010/0066967 A1 3/2010 Takahashi et al.
2010/0109994 A1 5/2010 Lee et al.
2010/0171687 A1 7/2010 Chiang et al.
2010/0309421 A1 12/2010 Gotoh et al.
2011/0273419 A1 11/2011 Park et al.
2011/0279418 A1 11/2011 Han et al.
2012/0026144 A1* 2/2012 Kang ..... G09G 3/3225 345/211
2012/0146004 A1 6/2012 Lee et al.
2012/0229438 A1* 9/2012 Fujita ..... G09G 3/3283 345/211
2013/0093657 A1 4/2013 Song et al.
2013/0113766 A1 5/2013 Kim et al.
2014/0034923 A1 2/2014 Kim et al.
2014/0043306 A1 2/2014 Min et al.
2014/0077176 A1 3/2014 Lee et al.
2014/0098078 A1 4/2014 Jeon et al.
2014/0111490 A1 4/2014 Lee et al.
2014/0132584 A1* 5/2014 Kim ..... H01L 21/02063 345/212
2014/0152938 A1 6/2014 Lee et al.
2014/0168552 A1 6/2014 Jo et al.
2014/0306867 A1 10/2014 Qing et al.
2014/0312326 A1 10/2014 Moon et al.
2015/0009105 A1 1/2015 Nomura
2015/0049126 A1 2/2015 Jung
2015/0102303 A1 4/2015 Kim
2016/0217740 A1 7/2016 Lee et al.
2016/0247874 A1 8/2016 Gai et al.
2017/0154566 A1 6/2017 Ryoo et al.

FOREIGN PATENT DOCUMENTS

JP 2009-69768 A 4/2009
KR 10-0599470 B1 7/2006
KR 10-2007-0019463 A 2/2007
KR 10-0721944 B1 5/2007
KR 10-2012-0044499 A 5/2012
KR 10-1161865 B1 7/2012
KR 2001-0112360 A 1/2020
TW 201035938 A1 10/2010

OTHER PUBLICATIONS

EPO Extended Search Report dated Sep. 18, 2018, for corresponding European Patent Application No. 18178255.8 (10 pages).
Taiwanese Office Action dated Jan. 22, 2020, for corresponding Taiwanese Patent Application No. 105101676 (8 pages).

* cited by examiner

NON-RECTANGULAR DISPLAY AND DRIVING METHOD THEREOF

CROSS-REFERENCE TO RELATED APPLICATION

This application is a divisional of U.S. patent application Ser. No. 14/872,926, filed Oct. 1, 2015, which claims priority to and the benefit of Korean Patent Application No. 10-2015-0013045, filed Jan. 27, 2015, the entire content of both of which is incorporated herein by reference.

BACKGROUND

1. Field

Example embodiments of the present invention relate to a non-rectangular display.

2. Description of the Related Art

A display may include a plurality of pixels, a plurality of gate lines, and a plurality of data lines formed in a display panel, with the plurality of pixels being respectively connected to corresponding gate and data lines.

A plurality of scan signals are supplied via the plurality of gate lines, and a plurality of data signals are supplied via the plurality of data lines.

However, when a display panel is formed in a non-rectangular shape such as, for example, a circular display unit, the design and functionality of the display panel may be influenced by the shape of the display area.

For example, in a circular display panel, a bezel area around the display panel may have a limited width, because a larger bezel area may reduce the display area, which may further negatively impact the functionality of the display panel.

As the bezel area becomes narrower, however, the area where a driver IC for generating the plurality of scan and data signals can be positioned may be reduced. For example, the driver IC may be positioned in a set or predetermined region around an entire circumference of the circular display panel.

The driver IC includes a gate driving circuit and a data driving circuit. Depending on the arrangement of the driver IC, however, when gate and data lines are formed parallel to each other, coupling due to parasitic capacitance may occur therebetween. Accordingly, when a gate signal is applied to the gate line, the coupling between gate and data lines may interfere with or change a data signal of the data line.

The above information disclosed in this Background section is only for enhancement of understanding of the background of the invention and therefore it may contain information that does not constitute prior art.

SUMMARY

According to aspects of embodiments of the present invention, a non-rectangular display may be capable of preventing or reducing instances of coupling between gate and data lines due to parasitic capacitance.

According to example embodiments, a non-rectangular display includes: a plurality of first signal lines extending in a first direction; a plurality of DC voltage lines extending in the first direction; and a plurality of second signal lines extending in the first direction, wherein a first DC voltage line of the plurality of DC voltage lines is between a first line of the plurality of first signal lines and a second line of the plurality of second signal lines, a second DC voltage line of the plurality of DC voltage lines is between a third line of the plurality of first signal lines and a fourth line of the plurality of second signal lines, and the first and third lines are adjacent to each other, or the second and fourth lines are adjacent to each other.

When the first and third lines are adjacent to each other, the second line, the first DC voltage line, the first line, the third line, the second DC voltage line, and the fourth line may be sequentially arranged.

At least one pair of the first line and the third line, the second line and the fourth line, and the first DC voltage lines and the second DC voltage line are arranged symmetrically to each other based on a reference line.

When the second and fourth lines are adjacent to each other, the first line, the first DC voltage line, the second line, the fourth line, the second DC voltage line, and the third line may be sequentially arranged.

At least one pair of the first line and the third line, the second line and the fourth line, and the first DC voltage line and the second DC voltage line may be arranged symmetrically to each other based on a reference line.

The non-rectangular display may further include a plurality of pixels configured to receive a plurality of signals transmitted via the plurality of first signal lines while being respectively synchronized with a plurality of signals transmitted via the plurality of second signal lines.

The non-rectangular display may further include a plurality of third signal lines connected to the plurality of second signal lines at a plurality of contact points and extending in a second direction crossing the first direction.

The non-rectangular display may further include a plurality of pixels configured to receive a plurality of data signal transmitted via the plurality of first signal lines while being respectively synchronized with a plurality of scanning signals transmitted via the plurality of third signal lines.

The plurality of pixels may include: a plurality of switching transistors comprising first electrodes connected to the plurality of first signal lines and the plurality of third signal lines as gate electrodes; and a plurality of driving transistors comprising gate electrodes connected to second electrodes of the plurality of switching transistors, first electrodes configured to receive voltages via the plurality of DC voltage lines, and second electrodes connected to organic light emitting diodes (OLEDs).

The plurality of pixels may be configured to receive an initialization voltage while being synchronized with a plurality of scanning signals transmitted via the third signal lines corresponding to a previous pixel row.

The non-rectangular display may further include a plurality of initialization voltage lines configured to supply the initialization voltage and extending in the second direction.

The plurality of pixels may include: a plurality of switching transistors comprising first electrodes connected to the plurality of first signal lines and the plurality of third signal lines as gate electrodes; a plurality of driving transistors comprising first electrodes connected to second electrodes of the plurality of switching transistors, and second electrodes connected to OLEDs; and a plurality of compensation transistors connected between the gate electrodes of the plurality of driving transistors and the second electrodes of the plurality of switching transistors, the plurality of compensation transistors comprising the plurality of third signal lines as a gate electrode.

The plurality of pixels may further include a plurality of initialization transistors including first electrodes connected to the gate electrodes of the plurality of driving transistors and the plurality of third signal lines corresponding to the previous pixel row as a gate electrode.

The non-rectangular display may further include a plurality of light emission control lines configured to transmit a plurality of light emission control signals.

According to example embodiments, a non-rectangular display includes: a plurality of semiconductors; a gate insulating layer on the plurality of semiconductors; a first electrode on the gate insulating layer; a first interlayer insulating layer on the first electrode; a second electrode on the first interlayer insulating layer; a second interlayer insulating layer on the second electrode; and a first signal line, a DC voltage line, and a second signal line on the second interlayer insulating layer.

The DC voltage line may be connected to the second electrode via a contact hole.

The non-rectangular display may further include a plurality of pixels configured to receive a data signal synchronized with a scanning signal transmitted via the second signal line and transmitted via the first signal line, and configured to receive a driving voltage via the DC voltage line.

The non-rectangular display may further include a third signal line formed on a same layer as the first electrode and connected to the second signal line via a contact hole.

According to example embodiments, a non-rectangular display includes: a first signal line extending in a first direction; a second signal line extending in the first direction; a DC voltage line between the first and second signal lines in the first direction; and a third signal line connected to the second signal line via a contact hole and extending in a second direction crossing the first direction.

The non-rectangular display may further include a plurality of pixels configured to receive a data signal synchronized with a scanning signal transmitted via the second signal line and transmitted via the first signal line, and to receive a driving voltage via the DC voltage line.

DETAILED DESCRIPTION

Figure 1:
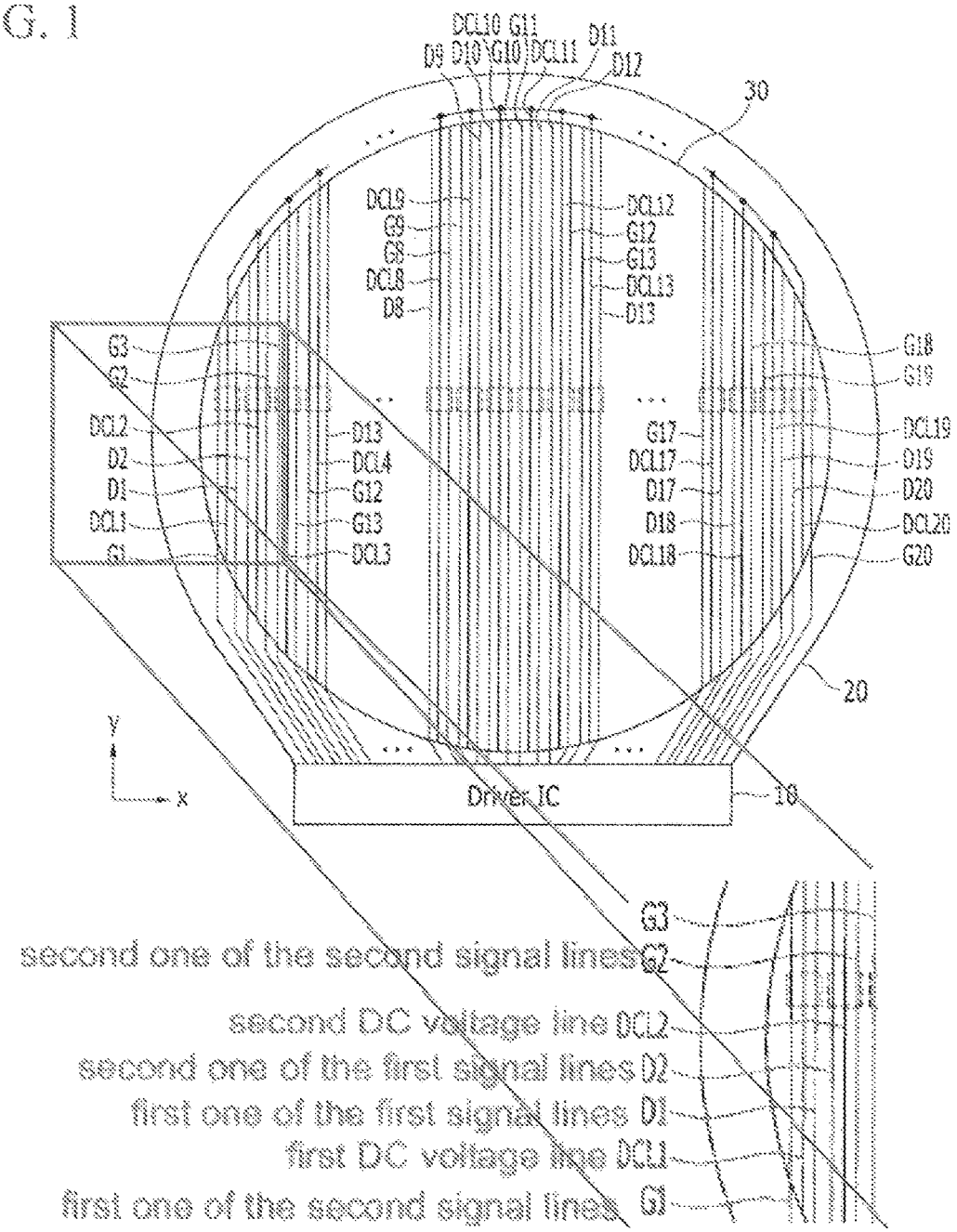
FIG. 1 is a layout view illustrating some components of a display, according to an example embodiment of the present invention.

Hereinafter, example embodiments will be described in more detail with reference to the accompanying drawings, in which like reference numbers refer to like elements throughout. The present invention, however, may be embodied in various different forms, and should not be construed as being limited to only the illustrated embodiments herein. Rather, these embodiments are provided as examples so that this disclosure will be thorough and complete, and will fully convey the aspects and features of the present invention to those skilled in the art. Accordingly, processes, elements, and techniques that are not necessary to those having ordinary skill in the art for a complete understanding of the aspects and features of the present invention may not be described.

In the following detailed description, example embodiments of the present invention have been shown and described by way of illustration. As those skilled in the art would realize, however, the described embodiments may be modified in various different ways, all without departing from the spirit or scope of the present invention.

Accordingly, the drawings and description are to be regarded as illustrative in nature and not restrictive. Like reference numerals designate like elements throughout the specification.

Throughout this specification and the claims that follow, when it is described that an element is "coupled" to another element, the element may be "directly coupled" to the other element or "electrically coupled" to the other element through a third element.

Further, unless explicitly described to the contrary, the word "comprise" and variations such as "comprises" or "comprising" will be understood to imply the inclusion of stated elements but not the exclusion of any other elements.

FIG. 1 is a layout view illustrating some components of a display according to an example embodiment.

In FIG. 1, a plurality of first signal lines D1 to D20, a plurality of second signal lines G1 to G20, and a plurality of DC voltage lines DCL1 to DCL20 are formed in a non-rectangular display panel 20. The number of first signal lines, second signal lines, and DC voltage lines may vary according to the design of the non-rectangular display panel 20.

The plurality of DC voltage lines DCL1 to DCL20 may be applied with the same DC voltage because they are connected to one DC voltage line DCL.

The plurality of first signal lines D1 to D20 are respectively formed to extend in a y-axis direction and arranged with one another along an x-axis direction, and are connected to a driver IC 10.

The plurality of second signal lines G1 to G20 are respectively formed to extend in the y-axis direction and arranged with one another along the x-axis direction, and are connected to the driver IC 10.

The plurality of DC voltage lines DCL1 to DCL20 are formed between the plurality of first signal lines D1 to D20 and the plurality of second signal lines G1 to G20.

The plurality of DC voltage lines DCL1 to DCL20 are respectively formed between the corresponding first and second signal lines to extend in the y-axis direction and arranged with one another along the x-axis direction.

For example, the DC voltage line DCL1 is arranged between the first signal line D1 and the second signal line G1, and the DC voltage line DCL2 is arranged between the first signal line D2 and the second signal line G2.

Along the X-axis direction, the second signal line, the DC voltage line, the first signal line, the first signal line, the DC voltage line, and the second signal line are sequentially arranged.

For example, according to some embodiments, the lines G1, DCL1, D1, D2, DCL2, and G2 may be sequentially arranged.

According to some embodiments, the first signal line, the DC voltage line, the second signal line, the second signal line, the DC voltage line, and the first signal line may be sequentially arranged.

For example, according to some embodiments, the lines D4, DCL4, G5, G6, DCL6, and D6 may be sequentially arranged.

Hereinafter, such arrangement will be called flip arrangement.

According to the flip arrangement, the first signal line positioned between two adjacent ones (e.g., G2 and G3) of the plurality of second signal lines G1 to G20 does not exist.

Similarly, the second signal line positioned between the two adjacent ones (e.g., D3 and D4) of the plurality of first signal lines D1 to D20 does not exist.

For example, the plurality of first signal lines D1 to D20 may be a plurality of data lines through which a plurality of data signals are transmitted, and a plurality of second signal lines G1 to G20 may be a plurality of gate lines through which a plurality of gate signals are transmitted.

Therefore, the corresponding one of the plurality of DC voltage lines DCL1 to DCL20 is positioned between the data line and the gate line.

In the related art, coupling between the data and gate signals may occur due to parasitic capacitance generated between the data and gate lines.

However, according to the example embodiment, the DC voltage line is connected between the data and gate lines, so incidences of coupling due to the parasitic capacitance may be prevented or reduced.

For example, in the related art, when the DC voltage line is not present, the gate signal abruptly changes while the data signal is being supplied via the data line, and the data signal may change because of the coupling due to the parasitic capacitance between the two lines.

However, because the DC voltage line is present between the two lines according to example embodiments of the present invention, no parasitic capacitance is generated between the gate and data lines.

Accordingly, a change in the data signal due to the coupling may not occur.

In FIG. 1, a circular display panel is illustrated as an example of the non-rectangular display panel 20.

However, the present invention is not limited thereto.

For example, the display panel 20 may be formed in an overall or generally circular shape, a partially circular shape, or a polygonal shape instead of the circular shape.

Due to differences in shape from those of related art rectangular displays, example embodiments of the present invention can be applied to the non-rectangular display panel in which the plurality of gate lines are formed to extend in the same direction as the plurality of data lines.

In a display unit 30 of the circular display panel 20, a plurality of pixels may be formed such that they are operated by signals transmitted via corresponding first signal lines D1 to D20 and corresponding second signal lines G1 to G20.

For example, at a center of FIG. 1, pixel rows marked with a plurality of dotted line boxes are illustrated.

The pixel rows are illustrated only to show one example of forming the pixels, but the example embodiment is not limited thereto.

That is, in the display unit 30, the plurality of pixels may be formed in various configurations or arrangements.

Figure 2:
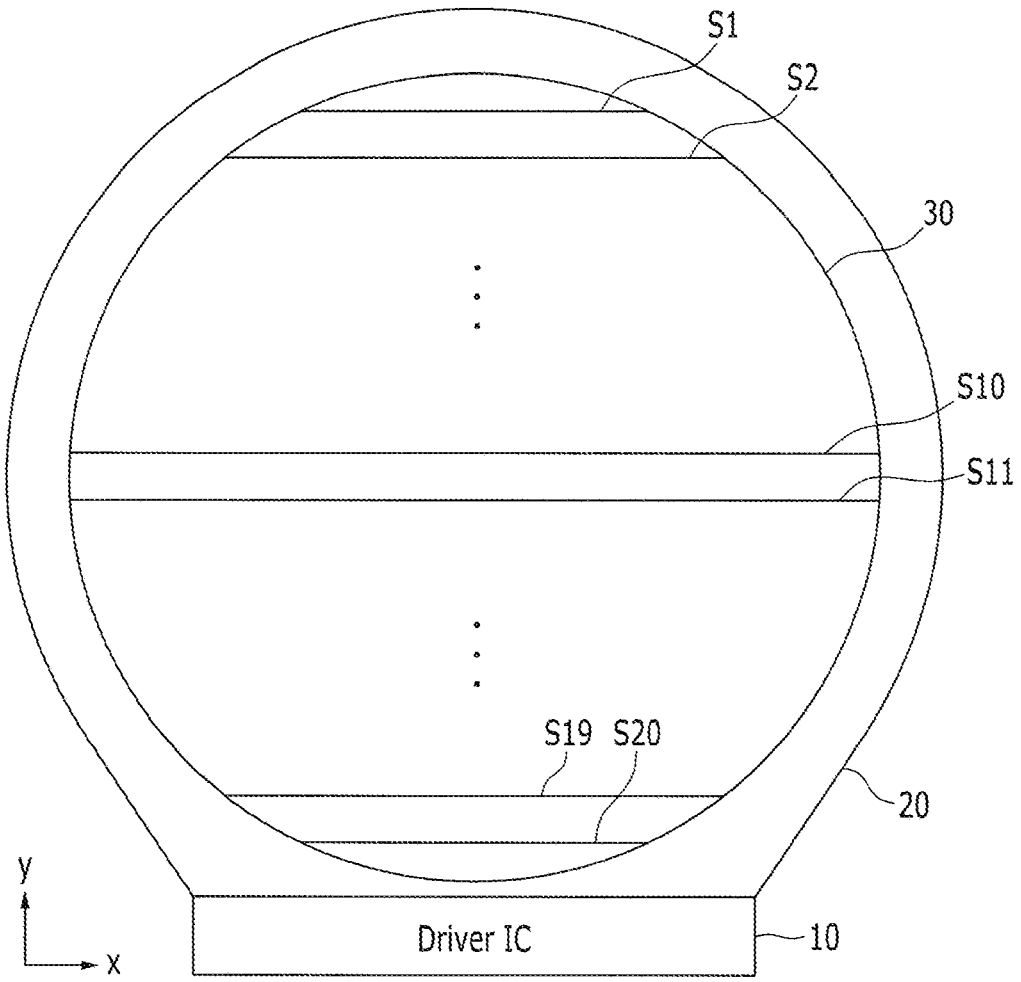
FIG. 2 is a layout view illustrating additional components of the display shown in FIG. 1, according to an example embodiment of the present invention.

FIG. 2 is a layout view illustrating additional components of the display shown in FIG. 1, according to example embodiments of the present invention.

In FIG. 2, a plurality of third signal lines S1 to S20 are formed in the display panel 20.

A first layer previously illustrated in FIG. 1 where the plurality of first signal lines D1 to D20, the plurality of second signal lines G1 to G20, and the plurality of DC voltage lines are formed is different from a second layer illustrated in FIG. 2 where a plurality of third signal lines S1 to Sn are formed. The number of third signal lines may vary according to the design of the display panel 20.

The first layer is formed or positioned on the second layer, and an insulating layer may be positioned between the first layer and the second layer.

Alternatively, the second layer may be formed or positioned on the first layer.

In the second layer illustrated in FIG. 2, only the plurality of third signal lines S1 to S20 are illustrated, but the present invention is not limited thereto.

For ease of description of the example embodiment, only the plurality of lines S1 to S20 electrically connected via the plurality of second signal lines G1 to G20 and a plurality of contact points are illustrated, but the present invention is not limited thereto.

A plurality of different signal lines may be formed in the second layer.

Figure 3:
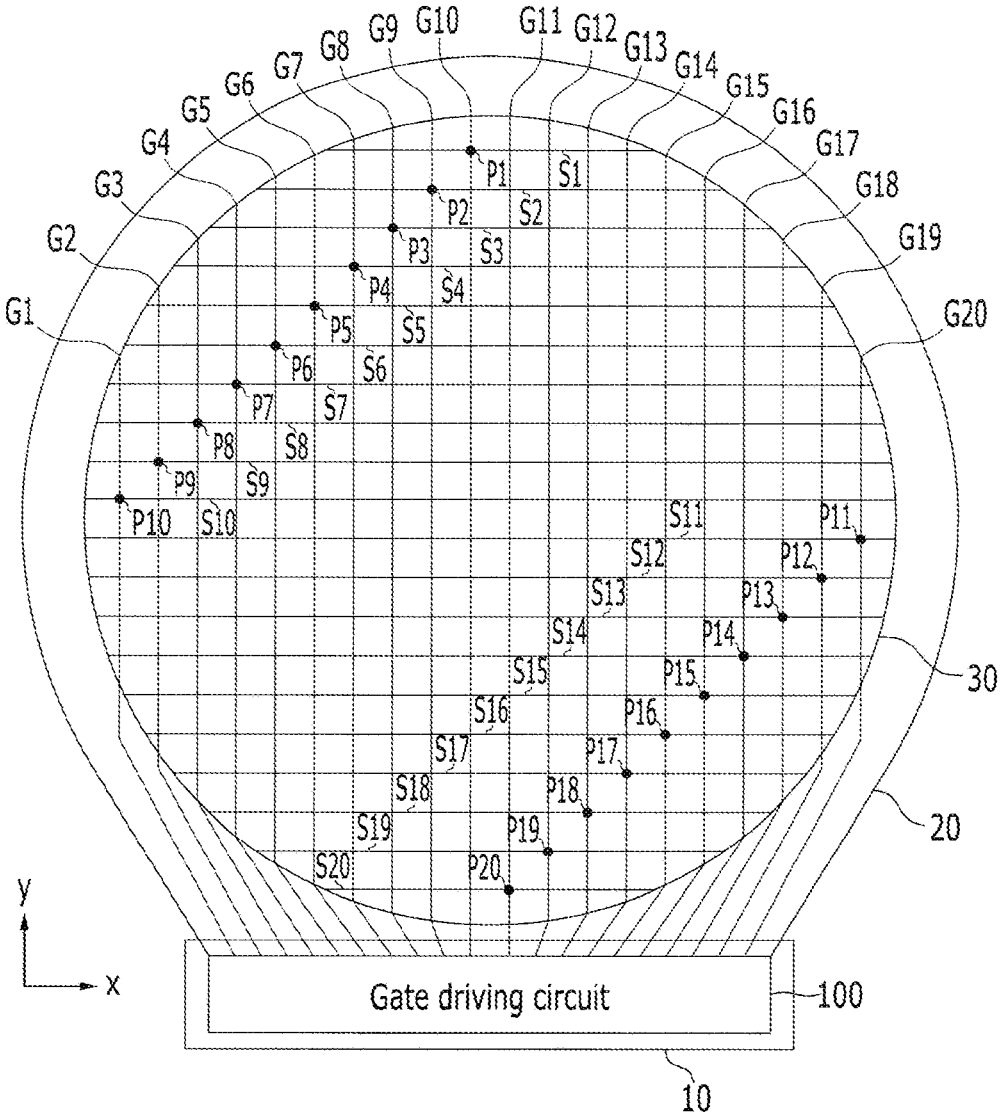
FIG. 3 is a layout view illustrating a plurality of contact points through which a plurality of third signal lines and a plurality of second signal lines are connected, according to an example embodiment of the present invention.

FIG. 3 is a layout view illustrating a plurality of contact points through (via) which the plurality of third signal lines and the plurality of second signal lines are connected.

In FIG. 3, the plurality of third signal lines S1 to S20 connected to the plurality of second signal lines G1 to G20 are illustrated.

The layer formed with the plurality of lines G1 to G20 and the layer formed with the plurality of lines S1 to S20 may be different from each other, and two corresponding lines (one of G1 to G20 and one of P1 to P20) in the plurality of contact points P1 to P20 may be connected to each other.

The plurality of contact points P1 to P20 may be formed (e.g., each formed) by forming a contact opening (e.g., a contact hole), with a contact electrode formed in the contact opening, but the implementation is not limited thereto.

A gate driving circuit 100 is connected to a plurality of gate lines G1 to G20, and generates and outputs a plurality of gate signals to the plurality of gate lines G1 to G20.

The plurality of gate lines G1 to G20 are connected to a plurality of scanning lines S10, S9, S8, . . . , S1, S11, S12, . . . , S18, S19, and S20 through the plurality of contact points P10, P9, P8, . . . , P1, P11, P12, . . . , P18, P19, and P20.

For example, the gate line G1 is connected to the scanning line S10 through the contact point P10, the gate line G2 is connected to the scanning line S9 through the contact point P9, the gate line G3 is connected to the scanning line S8 through the contact point P8, and the gate line G10 is connected to the scanning line S1 through the contact point P1.

The gate line G20 is connected to the scanning line S11 through the contact point P11, the gate line G19 is connected to the scanning line S12 through the contact point P12, the gate line G18 is connected to the scanning line S13 through the contact point P13, and the gate line G11 is connected to the scanning line S20 through the contact point P20.

Figure 4:
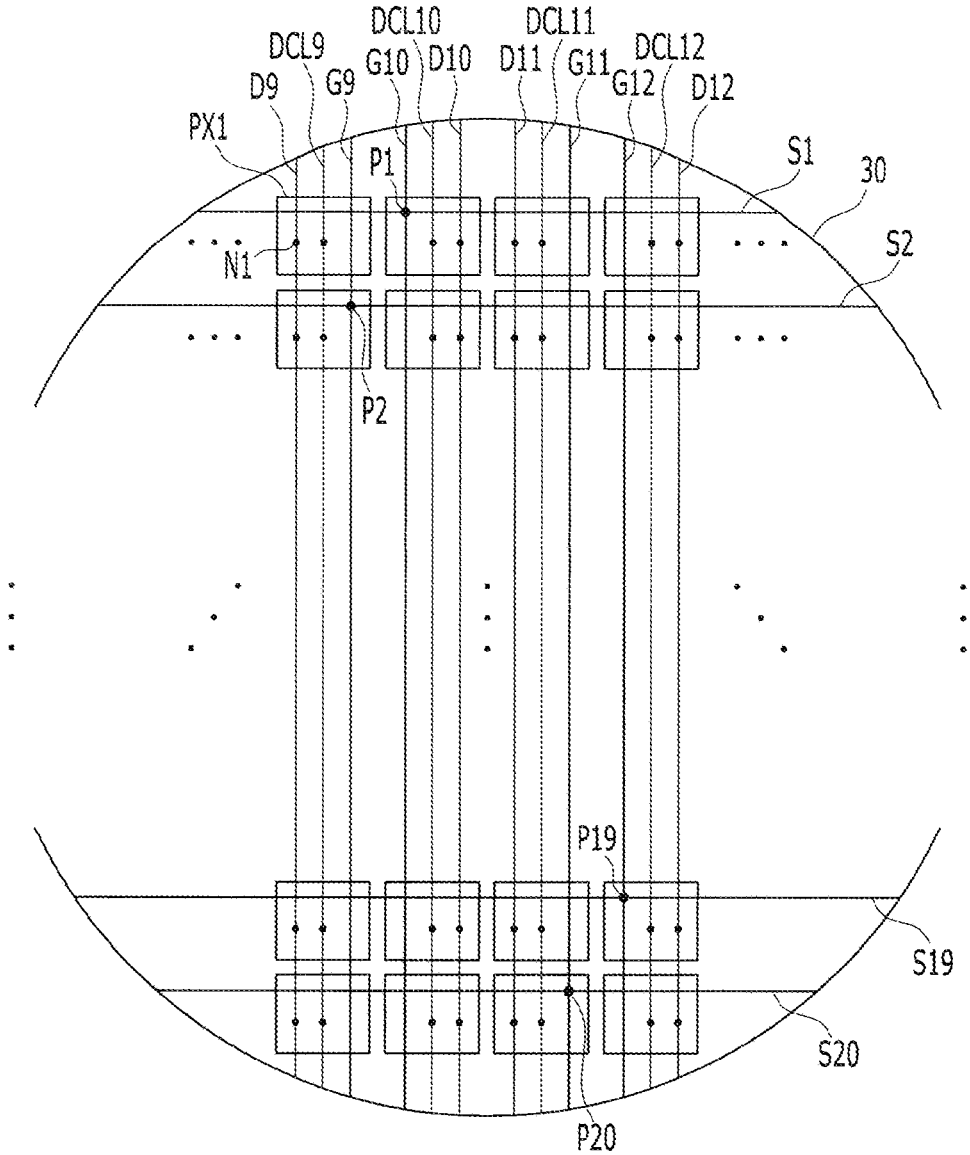
FIG. 4 is a schematic view illustrating a part of a circular display panel, according to an example embodiment of the present invention.

FIG. 4 is a schematic view illustrating a part of a circular display panel, according to example embodiments of the present invention.

Figure 5:
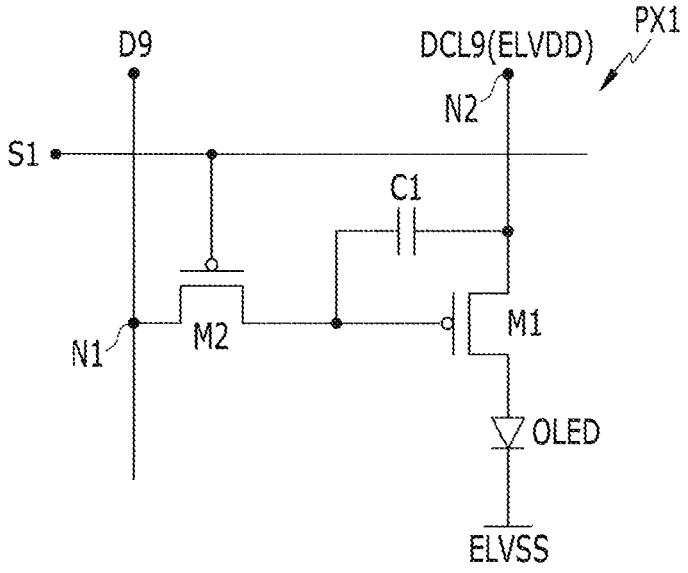
FIG. 5 is a circuit diagram of one of a plurality of pixels marked in FIG. 4, according to an example embodiment of the present invention.

FIG. 5 is a circuit diagram of one of a plurality of pixels marked in FIG. 4.

The plurality of contact points P1 to P20 illustrated in FIG. 3 may be applied to or included in the example embodiment illustrated in FIG. 4.

As shown in FIG. 4, a second signal line G10 and a scanning line S1 are connected at (e.g., through or via) a contact point P1, a second signal line G9 and a scanning line S2 are connected at a contact point P2, a second signal line G11 and a scanning line S20 are connected at a contact point P20, and a second signal line G12 and a scanning line S19 are connected at a contact point P19.

As shown in FIG. 5, a pixel PX1 includes a driving transistor M1, a switching transistor M2, a capacitor C1 formed or positioned between gate and source electrodes of the driving transistor M1, and an organic light emitting diode (OLED).

As shown in FIG. 4, a plurality of pixels marked with quadrangle boxes are formed in a display unit 30.

A plurality of first signal lines D1 to D20, a plurality of DC voltage lines DCL1 to DCL20, and a plurality of third signal lines S1 to S20 that are connected to the plurality of pixels may be a plurality of data lines, a plurality of ELVDD voltage lines, and a plurality of scanning lines, respectively.

The plurality of second signal lines G1 to G20 may be the plurality of gate lines for transmitting a plurality of scanning signals outputted from the gate driving circuit 100 to the plurality of scanning lines S1 to S20.

The plurality of data signals are written to the plurality of pixels while being respectively synchronized with the plurality of scanning signals transmitted via the plurality of data lines.

In addition, ELVDD voltages supplied via the plurality of ELVDD voltage lines are provided to drive the plurality of pixels.

For example, in the single pixel PX1 of the plurality of pixels, the scanning line S1 is a gate electrode of the switching transistor M2 of the pixel PX1.

One electrode of the switching transistor M2 and a data line D9 are connected at a node N1.

For example, one electrode of the switching transistor M2 and the data line D9 may be connected through a contact electrode that is formed in a contact hole.

A source electrode of the driving transistor M1 and a DC voltage line DCL9 are connected at a node N2.

For example, the source electrode of the driving transistor M1 and the DC voltage line DCL9 may be connected through a contact electrode that is formed in a contact hole.

The source electrode of the driving transistor M1 may be connected to the DC voltage line DCL9 along with one electrode of the capacitor C1.

The other electrode of the switching transistor M2 is connected to the gate electrode of the driving transistor M1 and the other electrode of the capacitor C1.

A drain electrode of the driving transistor M1 is connected to an anode of the OLED.

A voltage VSS is supplied to a cathode of the OLED.

As such, the DC voltage line (e.g., ELVDD voltage supply line) may be positioned between the gate and data lines to prevent or reduce incidences of coupling due to parasitic capacitance between the gate and data lines.

A pixel circuit of one pixel PX1 is illustrated in FIG. 5, but the plurality of pixels illustrated in FIG. 4 may be implemented with the same pixel circuit as the pixel circuit illustrated in FIG. 5.

In FIG. 5, the flip arrangement according to the example embodiment is applied to the non-rectangular display panel including the pixels including two transistors and one capacitor, but the present invention is not limited thereto.

That is, the flip arrangement for sequentially arranging the gate line, the DC voltage line, and the data line is applicable to various pixel structures.

Figure 6:
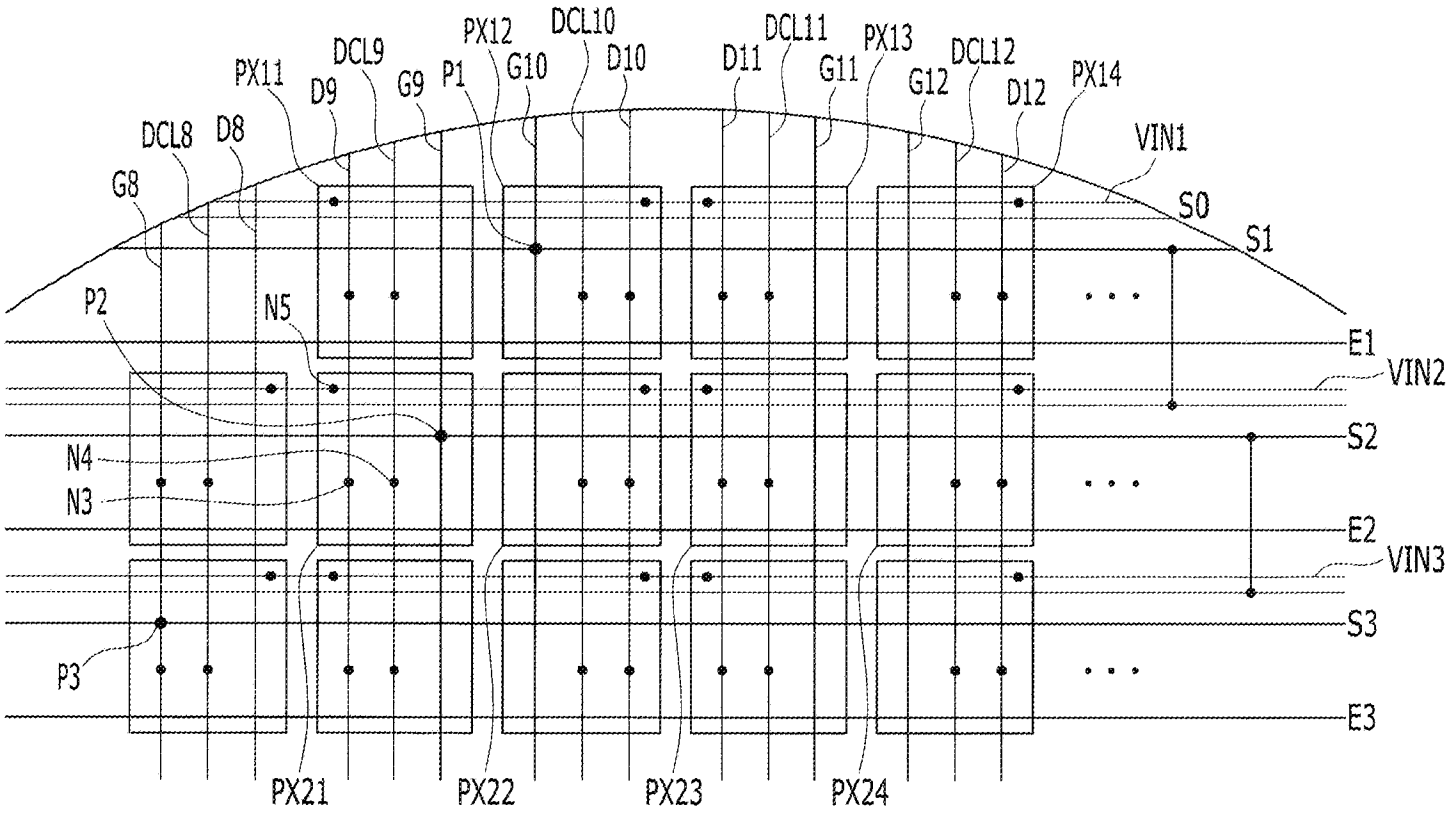
FIG. 6 is a schematic view illustrates a part of a circular display panel, according to an example embodiment of the present invention.

FIG. 6 is a schematic view illustrating a part of a circular display panel according to another example embodiment of the present invention.

Figure 7:
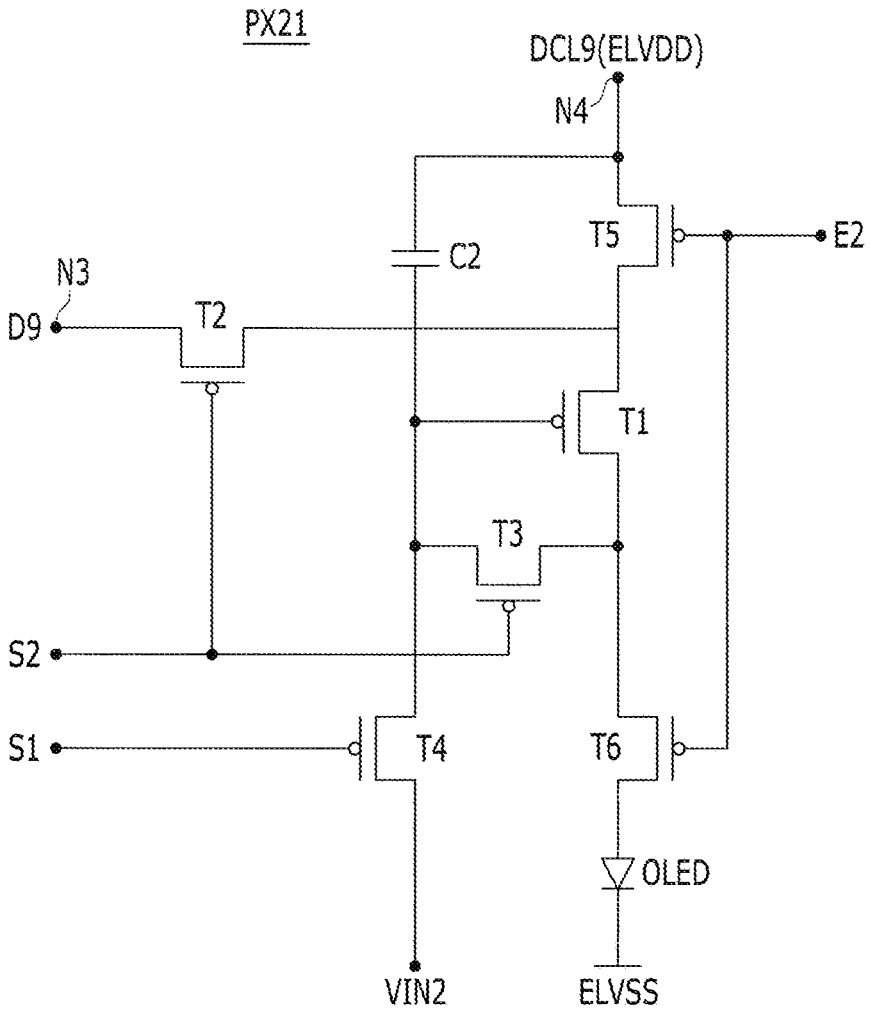
FIG. 7 is a circuit diagram of one of a plurality of pixels illustrated in FIG. 6, according to an example embodiment of the present invention.

FIG. 7 is a circuit diagram of one of a plurality of pixels illustrated in FIG. 6.

The plurality of contact points P1 to P20 illustrated in FIG. 3 may be applied to or utilized in the current example embodiment illustrated in FIG. 6.

As shown in FIG. 6, a second signal line G10 and a scanning line S1 are connected at a contact point P1, a second signal line G9 and a scanning line S2 are connected at a contact point P2, and a second signal line G8 and a scanning line S3 are connected at a contact point P3.

In FIG. 6, a scanning line S0 is additionally illustrated.

Second signal lines that are not illustrated in FIG. 3 may also be added and connected through contact points.

In this case, the added second signal lines may be appropriately arranged according to the flip arrangement.

As shown in FIG. 7, a pixel PX21 includes a driving transistor T1, a switching transistor T2, a compensation transistor T3, a capacitor C2 formed between a gate electrode of the driving transistor T1 and a DC voltage line DCL9, an initialization transistor T4, light emission control transistors T5 and T6, and an OLED.

As shown in FIG. 6, a plurality of pixels marked with quadrangle boxes are formed in a display unit 40.

A plurality of first signal lines D8 to D12, a plurality of DC voltage lines DC8 to DCL12, and a plurality of third signal lines S0 to S3 that are connected to the plurality of pixels may be a plurality of data lines, a plurality of ELVDD voltage lines, and a plurality of scanning lines, respectively.

A plurality of second signal lines G8 to G10 may be a plurality of gate lines for transmitting a plurality of scanning signals outputted from the gate driving circuit 100 to the corresponding plurality of scanning lines S1 to S3.

The plurality of scanning lines S1 to S3 are formed across the corresponding current pixel rows and across the next pixel rows thereof, respectively.

For example, the scanning line S1 is formed not only across the current pixel row including a plurality of pixels PX11 to PX14, but also across the next pixel row including a plurality of pixels PX21 to PX24.

As shown in FIG. 6, in the display unit 40, a plurality of initialization voltage lines (e.g., VIN1 to VIN3) through which an initialization voltage Vint is supplied and a plurality of light emission control lines (e.g., E1 to E3) through which a light emission control signal is supplied are further formed, along with a plurality of first signal lines, a plurality of DC voltage lines, and a plurality of third signal lines.

In addition, the two corresponding scanning lines of the plurality of scanning lines are arranged in the plurality of pixels.

In each pixel, the two scanning lines may be gate electrodes of the transistors (e.g., T2, T3, and T4).

The initialization voltage Vint may be supplied to the gate electrode of the driving transistor T1 of each of the plurality of pixels while synchronized with the plurality of scanning signals supplied via the plurality of scanning lines positioned in the previous pixel row.

Further, a plurality of data signals transmitted via the plurality of data lines are written in the plurality of pixels while being synchronized with the plurality of scanning signals transmitted via the plurality of scanning lines positioned in the current pixel row.

In addition, the ELVDD voltage supplied via the plurality of ELVDD voltage lines is provided to drive the plurality of pixels, and light emission of the OLED is controlled by a plurality of light emission control signals transmitted via the plurality of light emission control lines.

For example, in the pixel PX21, which is one of the plurality of pixels, the scanning line S1 is a gate electrode of the initialization transistor T4 of the pixel PX21, and the scanning line S2 is a gate electrode of the switching transistor T2 of the pixel PX21 and the compensation transistor T3.

One electrode of the switching transistor T2 and a data line D9 are connected at a node N3.

Figure 8:
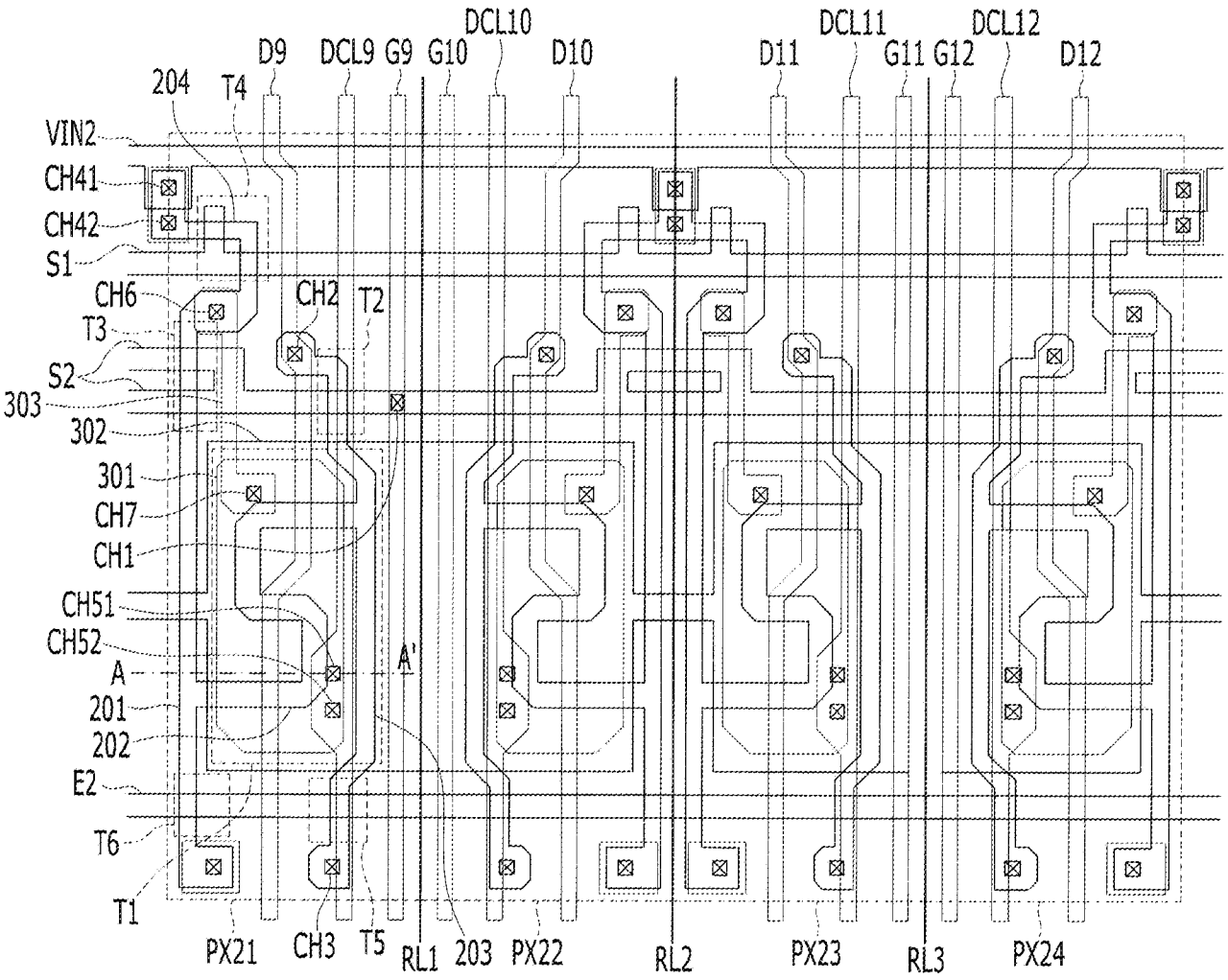
FIG. 8 is a plan view illustrating a layout of four pixels illustrated in FIG. 6, according to an example embodiment of the present invention.

For example, one electrode of the switching transistor T2 and the data line D9 may be connected through (via) the contact electrode that is formed in the contact hole (e.g., refer to CH2 of FIG. 8).

A source electrode of the light emission control transistor M5 and a DC voltage line DCL9 are connected at a node N4.

For example, the source electrode of the light emission control transistor M5 and the DC voltage line DCL9 may be connected through (via) the contact electrode that is formed in the contact hole (e.g., CH3 of FIG. 8).

One electrode of the initialization transistor T4 and the initialization voltage line VIN2 are connected at a node N5.

For example, one electrode of the initialization transistor T4 and the initialization voltage line VIN2 may be connected through the contact electrode that is formed in the contact hole (e.g., refer to CH41 and CH42 of FIG. 8).

The other electrode of the switching transistor T2 is connected to a source electrode of the driving transistor T1 and a drain electrode of the light emission control transistor T5.

The compensation transistor T3 is connected between the gate and drain electrodes of the driving transistor T1.

The other electrode of the initialization transistor T4 is connected to one electrode of the compensation transistor T3, the gate electrode of the driving transistor T1, and the other electrode of the capacitor C2.

The light emission control transistor T6 is connected between the drain electrode of the driving transistor T1 and an anode of the OLED.

The gate electrode of the light emission control transistors T5 and T6 is the light emission control line E2.

A voltage ELVSS is supplied to a cathode of the OLED.

FIG. 8 is a top plan view illustrating a layout of four pixels illustrated in FIG. 6.

As shown in FIG. 8, the lines D9, DCL9, and G9, and G10, DCL10, and D10, are arranged according to the flip arrangement.

Accordingly, the lines D9, DCL9, and G9 are arranged symmetrically with respect to the lines G10, DCL10, and D10, based on or around a reference line RL1.

The pixel PX21 is also arranged symmetrically with respect to the pixel PX22, based on or around the reference line RL1.

In addition, the lines G10, DCL10, and D10, and D11, DCL11, and G11, are arranged according to the flip arrangement.

Accordingly, the lines G10, DCL10, and D10 are arranged symmetrically with respect to the lines D11, DCL11, and G11, based on or around a reference line RL2.

The pixel PX22 is also arranged symmetrically with respect to the pixel PX23, based on or around the reference line RL2.

In addition, the lines D11, DCL11, and G11, and G12, DCL12, and D12, are arranged according to the flip arrangement.

Accordingly, the lines D11, DCL11, and G11 are arranged symmetrically with respect to the lines G12, DCL12, and D12, based on or around a reference line RL3.

The pixel PX23 is also arranged symmetrically with respect to the pixel PX24, based on or around the reference line RL3.

Compared with the pixel PX21, the pixels PX22 and PX24 are arranged symmetrically with respect to each other, and the pixel PX23 has the same structure.

For example, the pixel PX21 will be described in more detail.

In a contact hole CH1, the second signal line G9 and the third signal line S2 are connected through the contact electrode.

Each of the transistors T1 to T6 of the pixel circuit illustrated in FIG. 7 is marked with a dotted line box, as shown in FIG. 8.

Channel regions, source electrodes, and drain electrodes are formed in semiconductors 201, 202, 203, and 204.

In the semiconductor 201, channel regions, source electrodes, and drain electrodes of the compensation transistor T3 and the light emission control transistor T6 are formed.

In the semiconductor 202, a channel region, a source electrode, and a drain electrode of the driving transistor T1 are formed.

The semiconductor 201 is formed in an S-shape, but the present invention is not limited thereto.

In the semiconductor 203, channel regions, source electrode, and drain electrodes of the switching transistor T2 and the light emission control transistor T5 are formed.

In the semiconductor 204, a channel region, a source electrode, and a drain electrode of the initialization transistor T4 are formed.

The scanning line S1 is formed on the channel region of the initialization transistor T4 of the semiconductor 204 to cross the semiconductor 204.

The scanning line S2 is formed on the channel region of the switching transistor T2 of the semiconductor 203 and on the channel region of the compensation transistor T3 of the semiconductor 201 to cross the semiconductors 201 and 203.

The light emission control line E2 is formed on the channel region of the light emission control transistor T6 of the semiconductor 201 and on the channel region of the light emission control transistor T5 of the semiconductor 203 to cross the semiconductor 201 and the semiconductor 203.

The gate electrode of the driving transistor T1 and the other electrode of the capacitor C2 (lower electrode) is an electrode 301.

The DC voltage line DCL9 and the one electrode (upper electrode) of the capacitor C2 are connected through contact electrodes in contact holes CH51 and CH52.

One electrode of the switching transistor T2 is connected to the first signal line D9 through a contact hole CH2.

One electrode of the compensation transistor T3 is connected to the other electrode of the initialization transistor T4 through a contact hole CH6.

An electrode 303 is connected to the other electrode 301 of the capacitor C2 through a contact hole CH7, and is connected to one electrode of the compensation transistor T3 and the other electrode of the initialization transistor T4 through the contact hole CH6.

One electrode 302 of the capacitor C2 is connected to the DC voltage line DCL9 through the contact holes CH51 and CH52 such that the voltage ELVDD is supplied to one electrode of the capacitor C2.

Figure 9:
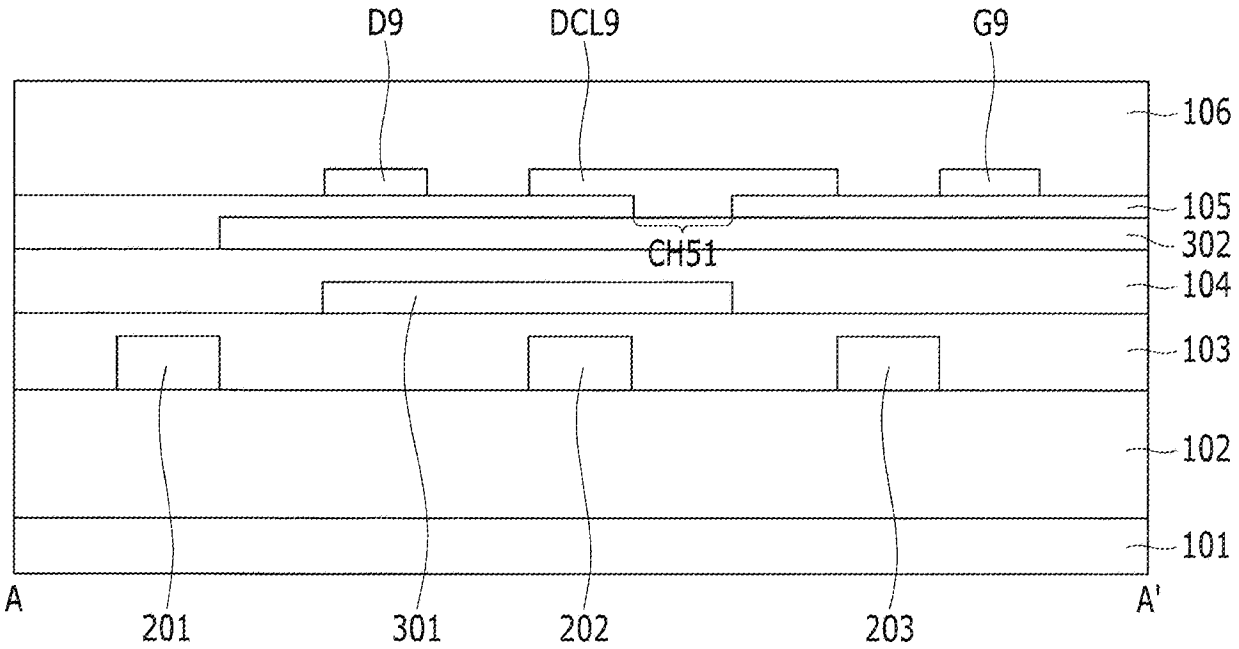
FIG. 9 is a cross-sectional view taken along the line A-A' of FIG. 8, according to an example embodiment of the present invention.

FIG. 9 is a cross-sectional view taken along the line A-A' of FIG. 8.

As shown in FIG. 9, a buffer layer 102 is formed on a substrate 101.

Semiconductors 201, 202, and 203 are formed on the buffer layer 102, and a gate insulating layer 103 is formed on the semiconductors 201, 202, and 203.

An electrode 301 is formed on the gate insulating layer 103, and an interlayer insulating layer 104 is formed thereon.

A plurality of third signal lines S1 to S20 may be formed on the same layer as the electrode 301.

For example, the third signal line S1 illustrated in FIG. 8 may be formed on the same layer as the electrode 301 to be connected to a second signal line G9 through a contact hole CH1.

An electrode 302 is formed on the interlayer insulating layer 104, and an interlayer insulating layer 105 is formed thereon.

A first signal line D9, a DC voltage line DCL9, and a second signal line G9 are formed on the interlayer insulating layer 105, and a contact hole CH51 is formed in the middle of the interlayer insulating layer 105 to connect the DC voltage line DCL9 and the electrode 302.

The example embodiments of the non-rectangular display panel including the first signal line, the DC voltage line, and the second signal line that are arranged according to the flip arrangement has been described.

The DC voltage line may be arranged between the first and second signal lines to prevent or reduce incidences of the parasitic capacitance between the first and second signal lines from being generated, such that incidences of signal distortions transmitted to each of the first and second signal lines can be prevented or reduced.

In the aforementioned example embodiments, the DC voltage line formed between the first and second signal lines has been described to supply the ELVDD voltage, but the present invention is not limited thereto.

The other voltage for driving the pixels may be supplied.

Unless otherwise noted, like reference numerals denote like elements throughout the attached drawings and the written description, and thus, descriptions thereof will not be repeated. In the drawings, the relative sizes of elements, layers, and regions may be exaggerated for clarity.

It will be understood that, although the terms "first," "second," "third," etc., may be used herein to describe various elements, components, regions, layers and/or sections, these elements, components, regions, layers and/or sections should not be limited by these terms. These terms are used to distinguish one element, component, region, layer or section from another element, component, region, layer or section. Thus, a first element, component, region, layer or section described below could be termed a second element, component, region, layer or section, without departing from the spirit and scope of the present invention.

Spatially relative terms, such as "beneath," "below," "lower," "under," "above," "upper," and the like, may be used herein for ease of explanation to describe one element or feature's relationship to another element(s) or feature(s) as illustrated in the figures. It will be understood that the spatially relative terms are intended to encompass different orientations of the device in use or in operation, in addition to the orientation depicted in the figures. For example, if the device in the figures is turned over, elements described as "below" or "beneath" or "under" other elements or features would then be oriented "above" the other elements or features. Thus, the example terms "below" and "under" can encompass both an orientation of above and below. The device may be otherwise oriented (e.g., rotated 90 degrees or at other orientations) and the spatially relative descriptors used herein should be interpreted accordingly.

It will be understood that when an element or layer is referred to as being "on," "connected to," or "coupled to" another element or layer, it can be directly on, connected to, or coupled to the other element or layer, or one or more intervening elements or layers may be present. In addition, it will also be understood that when an element or layer is referred to as being "between" two elements or layers, it can be the only element or layer between the two elements or layers, or one or more intervening elements or layers may also be present.

The terminology used herein is for the purpose of describing particular embodiments only and is not intended to be limiting of the present invention. As used herein, the singular forms "a" and "an" are intended to include the plural forms as well, unless the context clearly indicates otherwise. It will be further understood that the terms "comprises," "comprising," "includes," and "including," when used in this specification, specify the presence of the stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Expressions such as "at least one of," when preceding a list of elements, modify the entire list of elements and do not modify the individual elements of the list.

As used herein, the term "substantially," "about," and similar terms are used as terms of approximation and not as terms of degree, and are intended to account for the inherent deviations in measured or calculated values that would be recognized by those of ordinary skill in the art. Further, the use of "may" when describing embodiments of the present invention refers to "one or more embodiments of the present invention." As used herein, the terms "use," "using," and "used" may be considered synonymous with the terms "utilize," "utilizing," and "utilized," respectively. Also, the term "exemplary" is intended to refer to an example or illustration.

The electronic or electric devices and/or any other relevant devices or components according to embodiments of the present invention described herein may be implemented utilizing any suitable hardware, firmware (e.g. an application-specific integrated circuit), software, or a combination of software, firmware, and hardware. For example, the various components of these devices may be formed on one integrated circuit (IC) chip or on separate IC chips. Further, the various components of these devices may be implemented on a flexible printed circuit film, a tape carrier package (TCP), a printed circuit board (PCB), or formed on one substrate. Further, the various components of these devices may be may be a process or thread, running on one or more processors, in one or more computing devices, executing computer program instructions and interacting with other system components for performing the various functionalities described herein. The computer program instructions are stored in a memory which may be implemented in a computing device using a standard memory device, such as, for example, a random access memory (RAM). The computer program instructions may also be stored in other non-transitory computer readable media such as, for example, a CD-ROM, flash drive, or the like. Also, a person of skill in the art should recognize that the functionality of various computing devices may be combined or integrated into a single computing device, or the functionality of a particular computing device may be distributed across one or more other computing devices without departing from the spirit and scope of the exemplary embodiments of the present invention.

Unless otherwise defined, all terms (including technical and scientific terms) used herein have the same meaning as commonly understood by one of ordinary skill in the art to which the present invention belongs. It will be further understood that terms, such as those defined in commonly used dictionaries, should be interpreted as having a meaning that is consistent with their meaning in the context of the relevant art and/or the present specification, and should not be interpreted in an idealized or overly formal sense, unless expressly so defined herein.

While this invention has been described in connection with what is presently considered to be practical example embodiments, it is to be understood that the invention is not limited to the disclosed embodiments, but, on the contrary, is intended to cover various modifications and equivalent arrangements included within the spirit and scope of the appended claims, and their equivalents.

DESCRIPTION OF SOME OF THE SYMBOLS

D1-D20: first signal lines
G1-G20: second signal lines
DCL1-DCL20: DC voltage lines
10: driver IC
20: display panel
30, 40: display unit
P1-P20: contact points
PX1, PX11-PX14, PX21-PX24: pixel
M1, M2, T1-T6: transistor
C1, C2: capacitor

What is claimed is:

1. A non-rectangular display comprising:
a plurality of pixels;
a plurality of semiconductors;
a gate insulating layer on the plurality of semiconductors;
a first electrode on the gate insulating layer;
a first interlayer insulating layer on the first electrode;
a second electrode on the first interlayer insulating layer;
a second interlayer insulating layer on the second electrode; and
a first signal line connected to one pixel from among the plurality of pixels, a DC voltage line connected to the one pixel, and a second signal line connected to the one pixel,
wherein the first signal line, the DC voltage line, and the second signal line are all formed directly on the second interlayer insulating layer, and
wherein the DC voltage line is between the first signal line and the second signal line.

2. The non-rectangular display of claim 1, wherein the DC voltage line is connected to the second electrode via a contact hole.

3. The non-rectangular display of claim 1, wherein the plurality of pixels are configured to receive a data signal synchronized with a scanning signal transmitted via the second signal line and transmitted via the first signal line, and are configured to receive a driving voltage via the DC voltage line.

4. The non-rectangular display of claim 1, further comprising a third signal line formed on a same layer as the first electrode and connected to the second signal line via a contact hole.

5. The non-rectangular display of claim 1, wherein the first interlayer insulating layer is between the first electrode and the second electrode in a thickness direction of the non-rectangular display.

6. The non-rectangular display of claim 5, further comprising a capacitor, the capacitor comprising the first electrode and the second electrode.

* * * * *